US009489786B2

(12) United States Patent
Lee

(10) Patent No.: US 9,489,786 B2
(45) Date of Patent: Nov. 8, 2016

(54) METHOD AND SYSTEM FOR CONTROLLING TRUNK OF VEHICLE TO BE OPENED OR CLOSED USING WEARABLE DEVICE

(71) Applicant: HYUNDAI MOTOR COMPANY, Seoul (KR)

(72) Inventor: Jong Bok Lee, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 46 days.

(21) Appl. No.: 14/555,971

(22) Filed: Nov. 28, 2014

(65) Prior Publication Data

US 2016/0055696 A1 Feb. 25, 2016

(30) Foreign Application Priority Data

Aug. 21, 2014 (KR) ..... 10-2014-0109123

(51) Int. Cl.
*G07C 9/00* (2006.01)

(52) U.S. Cl.
CPC ..... *G07C 9/00111* (2013.01); *G07C 9/00182* (2013.01); *G07C 9/00563* (2013.01); *G07C 2009/00968* (2013.01)

(58) Field of Classification Search
USPC ..... 340/5.61
See application file for complete search history.

(56) References Cited

U.S. PATENT DOCUMENTS

| | | | | |
|---|---|---|---|---|
| 7,783,391 | B2 * | 8/2010 | Jeong | A61B 5/04888 600/587 |
| 8,478,486 | B2 * | 7/2013 | Kato | B60N 2/002 340/467 |
| 2009/0326406 | A1 | 12/2009 | Tan et al. | |
| 2011/0184618 | A1 * | 7/2011 | Inoue | A61B 5/0492 701/70 |

FOREIGN PATENT DOCUMENTS

| | | | |
|---|---|---|---|
| KR | 10-0170919 | B1 | 5/1995 |
| KR | 10-1998-0009004 | A | 4/1998 |
| KR | 10-2007-0064083 | A | 6/2007 |
| KR | 10-2012-0062115 | A | 6/2012 |
| KR | 20-2013-0003902 | U | 7/2013 |
| KR | 10-2014-0023538 | A | 2/2014 |

OTHER PUBLICATIONS

Office Action Korean Patent Application No. 10-2014-0109123 dated Aug. 9, 2016.

Jangwon Lee, "MS, Electromyography (EMG) Control Demo Clip" gameshot.net News Article dated Jan. 5, 2010 http://www.gameshot.net/common/con_view.php?code=GA4b429da7c3fa2 & http://youtu.be/R1agrUM4KYs.

* cited by examiner

*Primary Examiner* — Mark Blouin
(74) *Attorney, Agent, or Firm* — McDermott Will & Emery LLP

(57) ABSTRACT

A method and a system for controlling a trunk to be opened or closed using a wearable device. The trunk may be opened or closed using a non-contact arrangement by causing the wearable device to generate an electromyogram (EMG) signal of a user depending on whether or not the user carries heavy luggage, and causing the vehicle to receive the EMG signal wirelessly.

16 Claims, 4 Drawing Sheets

METHOD AND SYSTEM FOR CONTROLLING TRUNK OF VEHICLE TO BE OPENED OR CLOSED USING WEARABLE DEVICE

CROSS-REFERENCE TO RELATED APPLICATION

This application is based on and claims the benefit of priority to Korean Patent Application No. 10-2014-0109123, filed on Aug. 21, 2014 in the Korean Intellectual Property Office, the disclosure of which is incorporated herein in its entirety by reference.

TECHNICAL FIELD

The present disclosure relates to a method and a system for controlling the trunk of a vehicle to be opened or closed by a user implementing a wearable device, and more particularly, to a method and a system for doing so, non-contactlessly, using a wearable device including recognizing a situation in which the user carries heavy luggage.

BACKGROUND

When a user is to approach a vehicle when he/she carries a heavy luggage and then load the luggage into the vehicle trunk, he/she generally puts the luggage down on the ground, opens the trunk, and then moves the luggage into the trunk. On the other hand, when the user unloads the luggage from the trunk, he/she generally takes the luggage out from the trunk, puts the luggage down on the ground, and then closes the trunk. There is a risk that the body of the user, such as at the waist, or the like, may become injured when putting the heavy luggage down on the ground when loading or unloading the heavy luggage into or from the trunk as described above.

In order to solve this problem, technology capable of automatically opening the trunk of the vehicle by installing a vehicle detector, an ultrasonic sensor, or the like, at the rear of the vehicle to recognize a gesture of the user approaching the rear of the vehicle has been developed.

However, the above-mentioned related art mainly relates to technology for opening the trunk; closing the trunk is not automatically performed, and there is still a risk that the user's body may be injured due to movement of the center of gravity of the user when the user assumes a gesture while he/she carries heavy luggage.

SUMMARY

The present disclosure has been made to solve the above-mentioned problems occurring in the prior art while advantages achieved by the prior art are maintained intact.

An aspect of the present disclosure provides a method and a system to enable a user to control the trunk of a vehicle to be opened or closed when using a wearable device capable of doing so in a non-contact manner by allowing the wearable device to generate an electromyogram (EMG) signal from the user depending on whether or not the user carries heavy luggage, and allowing the vehicle to receive the EMG signal in a wireless manner.

According to an exemplary embodiment of the present disclosure, a method for controlling a trunk of a vehicle to be opened or closed includes: generating an electromyogram signal for reactivity of a body of a user using an electromyogram sensor worn on the body of the user and transmitting the electromyogram signal; and controlling the trunk of the vehicle to be opened or closed depending on strength of the electromyogram signal received by the vehicle and distance of the user from the vehicle.

When the user loads or unloads an article into or from the trunk of the vehicle, the strength of the electromyogram signal from the electromyogram sensor worn on an arm of the user may be measured depending on weight of the corresponding article to open or close the trunk of the vehicle.

When a wearable device including the electromyogram sensor and a communication module wirelessly transmitting the electromyogram signal is worn on the body of the user, the vehicle may wirelessly receive the electromyogram signal from the communication module of the wearable device.

When a wearable device including the electromyogram sensor and a communication module transmitting the electromyogram signal through human body communication is worn on the body of the user, the vehicle may receive the electromyogram signal from the communication module of the wearable device through the human body communication.

The vehicle may transmit the electromyogram signal to an electronic device in a wired or wireless manner to control the electromyogram signal to be used as an input signal for health care treatment or an input signal for direction indication in the electronic device.

The controlling of the trunk of the vehicle to be opened or closed may include opening the trunk of the vehicle when the strength of the electromyogram signal is larger than a threshold value when the trunk of the vehicle is closed and maintaining the trunk of the vehicle in an opened state when strength of the electromyogram signal measured at a predetermined period is larger than the threshold value. The trunk of the vehicle may be closed when the user moves from the rear of the vehicle by a predetermined distance or more, when the strength of the electromyogram signal measured at the predetermined period is at the threshold value or less after the trunk of the vehicle is opened.

The controlling of the trunk of the vehicle to be opened or closed may include maintaining the trunk of the vehicle in an opened state when strength of the electromyogram signal measured at a predetermined period is larger than a threshold value in a state in which the trunk of the vehicle is opened. The trunk of the vehicle may be closed when the user moves from a rear of the vehicle by a predetermined distance or more, in the case in which the strength of the electromyogram signal measured at the predetermined period is the threshold value or less.

According to another exemplary embodiment of the present disclosure, a system for controlling a trunk of a vehicle to be opened or closed includes: a communicator configured to receive an electromyogram signal for reactivity of a body of a user generated in an electromyogram sensor worn on the body of the user; a distance sensor configured to sense a distance of the user from the vehicle; and a trunk controller configured to control the trunk of the vehicle to be opened or closed depending on strength of the electromyogram signal and the distance of the user from the vehicle.

When the user loads or unloads an article into or from the trunk of the vehicle, the strength of the electromyogram signal from the electromyogram sensor worn on an arm of the user may be measured depending on weight of the corresponding article to open or close the trunk of the vehicle.

When a wearable device including the electromyogram sensor and a communication module wirelessly transmitting the electromyogram signal is worn on the body of the user, the communicator may wirelessly receive the electromyogram signal from the communication module of the wearable device.

When a wearable device including the electromyogram sensor and a communication module transmitting the electromyogram signal through human body communication is worn on the body of the user, the communicator may receive the electromyogram signal from the communication module of the wearable device through the human body communication.

The system for controlling a trunk of a vehicle to be opened or closed may further include an interface configured to transmit the electromyogram signal to an electronic device in a wired or wireless scheme, wherein the interface controls the electromyogram signal to be used as an input signal for health care treatment or an input signal for direction indication in the electronic device.

The trunk controller may open the trunk of the vehicle when the strength of the electromyogram signal is larger than a threshold value when the trunk of the vehicle is closed and maintain the trunk of the vehicle in an opened state when strength of the electromyogram signal measured at a predetermined period is larger than the threshold value. The trunk controller may close the trunk of the vehicle when the user moves from a rear of the vehicle by a predetermined distance or more, when the strength of the electromyogram signal measured at the predetermined period is at the threshold value or less after the trunk of the vehicle is opened.

The trunk controller may maintain the trunk of the vehicle in an opened state when strength of the electromyogram signal measured at a predetermined period is larger than a threshold value when the trunk of the vehicle is opened. The trunk controller may close the trunk of the vehicle when the user moves from a rear of the vehicle by a predetermined distance or more, when the strength of the electromyogram signal measured at the predetermined period is at the threshold value or less.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
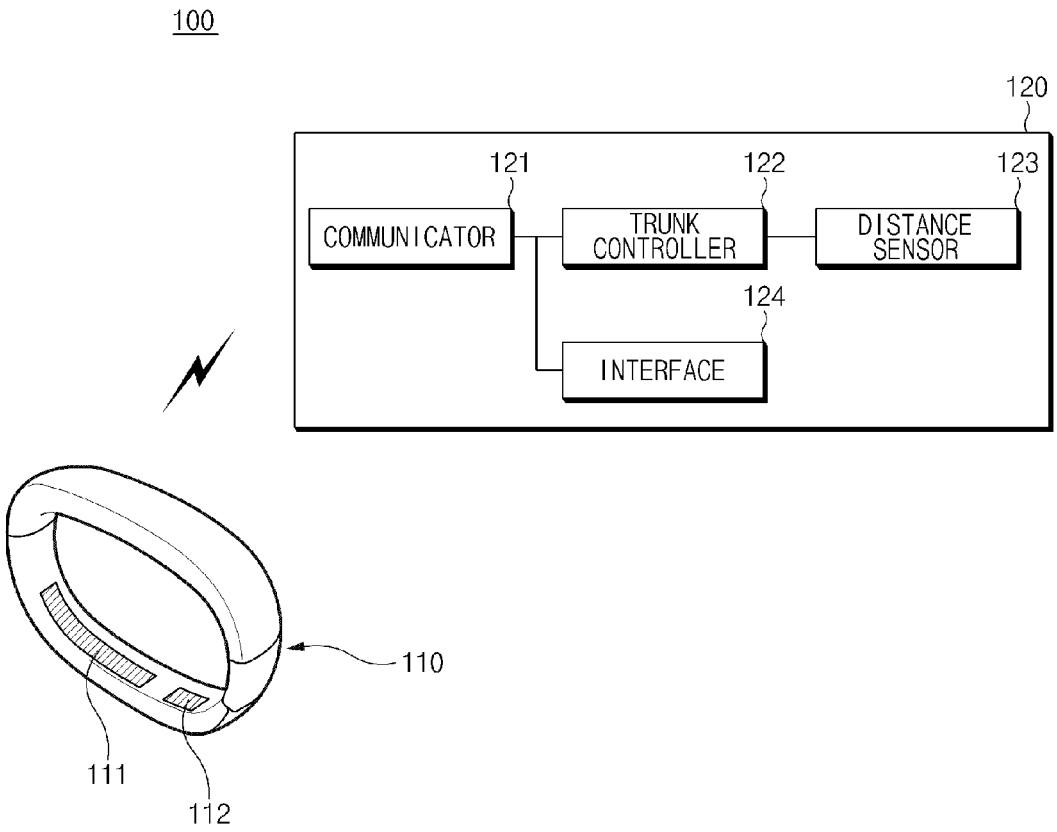
FIG. 1 is a diagram for describing a system for controlling a trunk to be opened or closed according to an exemplary embodiment of the present disclosure.

Hereinafter, the present disclosure will be described in detail with reference to the accompanying drawings. Throughout the accompanying drawings, the same components will be denoted by the same reference numerals. In addition, a detail description for functions and/or configurations that have been well-known will be omitted. In the following specification, portions required for understanding operations according to various exemplary embodiments will be mainly described, and a description for components that may obscure the gist of the present disclosure will be omitted. In addition, some components in the accompanying drawings may be exaggerated, omitted, or schematically shown. Sizes of the respective components do not reflect actual sizes of the respective components. Therefore, contents mentioned herein are not limited by relative sizes of or intervals between components shown in the accompanying drawings.

FIG. 1 is a diagram for describing a system 100 for controlling a trunk to be opened or closed according to an exemplary embodiment of the present disclosure.

Referring to FIG. 1, the system 100 for controlling a trunk to be opened or closed according to an exemplary embodiment of the present disclosure may be configured to include a wearable device 110 that may be easily worn on the body (all parts that may generate an electromyogram signal by contraction and relaxation of a muscle, such as arm, leg, waist, shoulder, heart part, and the like) of a user, and a trunk control module 120 mounted in a vehicle to open or close the trunk of the vehicle. The wearable device 110 may include an electromyogram sensor 111, a communication module 112, and the like, and the trunk control module 120 may include a communicator 121, a trunk controller 122, a distance sensor 123, and an interface 124.

First, operations of the respective components of the system 100 for controlling a trunk to be opened or closed according to an exemplary embodiment of the present disclosure will be briefly decreased.

The wearable device 110, which is a device generating the electromyogram (EMG) signal of the user depending on whether or not the user carries heavy luggage, includes the electromyogram sensor 111, which is an electromyography device generating the electromyogram signal for reactivity of the body of the user, and the communication module 112 transmitting the electromyogram signal to the vehicle.

The communication module 112 is a device transmitting and receiving a required signal through a short distance wireless communication scheme (for example, a Bluetooth scheme, a Zigbee, a near field communication (NFC) scheme, or the like) or wirelessly in a mobile communication scheme (for example, WiFi, WCDMA, Wibro, or the like) in some cases. The communication module 112 may also be a unit that may transmit and receive a required signal in a human body communication scheme (a communication scheme using fine current of the body). In some cases, the communication module 112 may be a module in which any one of the wireless scheme and the human body communication scheme as described above is used or both of them are integrated with each other.

The wearable device 110 may be manufactured in various forms such as in the form of a belt form, a bracelet, a band, a watch, and the like, so as to be easily worn on the body (all parts that may generate the electromyogram signal by contraction and relaxation of the muscle, such as the arm, leg, the waist, shoulder, heart part, and the like) of the user.

The electromyogram sensor 111 generates the electromyogram signal for the reactivity of the body of the user, and the electromyogram sensor 111 worn on the body so as to contact the arm, leg, waist, shoulder, heart part, and the like, depending on whether or not the user carries the heavy luggage may sense the contraction and the relaxation of the muscle to generate an electrical signal depending on a corresponding state. For example, the electromyogram sensor 111 may sense a fine electrical change flowing in the muscle dominated by a nerve depending on an operation of the muscle of the human body to generate an electrical signal for electrical activity. Since this principle is well-known, a detailed description thereof will be omitted.

The electromyogram signal for the reactivity of the body of the user generated by the electromyogram sensor 111 worn on the body of the user may be transmitted to the vehicle in the wireless scheme as described above through the communication module 112 or be transmitted to the vehicle in the human body communication scheme in which a signal is transmitted when a body part of the user, such as a finger, hip, or the like, touches the vehicle.

The electromyogram signal as described above generated from the wearable device 110 may be received in the short distance wireless communication scheme (for example, Bluetooth, Zigbee, NFC, or the like), the mobile communication scheme (for example, WiFi, WCDMA, the Wibro, or the like), human body communication, or the like, as described above through the communicator 121 of the trunk control module 120 installed in the vehicle.

The distance sensor 123 senses a distance between the user approaching the vehicle and the vehicle. Here, in order to sense the distance, a scheme of calculating a corresponding distance based on time between an incident wave and a reflected wave using an ultrasonic sensor, an infrared sensor, a radar sensor, or the like, may be used.

The trunk controller 122 may control the trunk of the vehicle to be opened or closed depending on strength of the electromyogram signal received as described above and the distance of the user from the vehicle. For example, when the electromyogram signal checked at a predetermined period when the user loads an article into the trunk of the vehicle is at a predetermined threshold value or more, the trunk controller 122 may control the trunk of the vehicle to be maintained in an opened state, and when the loading of the article is completed and the user becomes distant from the vehicle, the trunk controller 122 may control the trunk of the vehicle to be closed. In addition, when the electromyogram signal checked at a predetermined period during a time at which the user unloads an article from the trunk of the vehicle when the trunk of the vehicle is opened is at a predetermined threshold value or more, the trunk controller 122 may control the trunk of the vehicle to be maintained in an opened state, and when the unloading of the article is completed and the user becomes distant from the vehicle, the trunk controller 122 may control the trunk of the vehicle to be closed.

In some cases, a loading mode and an unloading mode for operations at the time of loading and unloading the article may be selected. For example, the user may select (for example, button select, or the like) the loading mode in the wearable device 110 at the time of loading the article, and the trunk controller 122 may support the operation as described above at the time of loading the article. In addition, the user may select (for example, button select, or the like) the unloading mode in the wearable device 110 at the time of unloading the article, and the trunk controller 122 may support the operation as described above at the time of unloading the article.

The interface 124 may transmit the above-mentioned electromyogram signal to another electronic device in a wired scheme or a wireless scheme (a short distance wireless communication scheme, a mobile communication scheme, or the like) to interwork with health care or a navigation service. For example, the electronic device for the application as described above may be a smart phone. In this case, when a health care application service is possible in the smart phone, the electromyogram signal may become an input signal for health care treatment. In addition, for example, the electronic device for the application as described above may be a navigation terminal. In this case, when a navigation service depending on direction indication is possible in the navigation terminal, the electromyogram signal may become an input signal for the direction indication. To this end, a plurality of wearable devices 110, for example, two or more wearable devices 110 may be used. When two wearable devices 110 are used and are worn on left and right arms, respectively, and a left or right direction indication input is generated depending on the electromyogram signal on the left or right arm, a required service may be provided depending on a left or right turn state of a driver in a turn by turn (TBT) service of the navigation terminal, or the like.

When the article is loaded into or unloaded from the trunk of the vehicle using the system 100 for controlling a trunk to be opened or closed as described above, strength of the electromyogram signal from the electromyogram sensor 111 worn on the arm of the user is measured depending on weight of the corresponding article to open or close the trunk of the vehicle, thereby making it possible to conveniently open or close the trunk of the vehicle in a non-contact scheme regardless of a specific gesture of the user.

Hereinafter, an operation at the time of loading or unloading an article into or from a trunk of a vehicle in the system 100 for controlling a trunk to be opened or closed according to an exemplary embodiment of the present disclosure will be described in more detail with reference to FIGS. 2 and 3.

Figure 2:
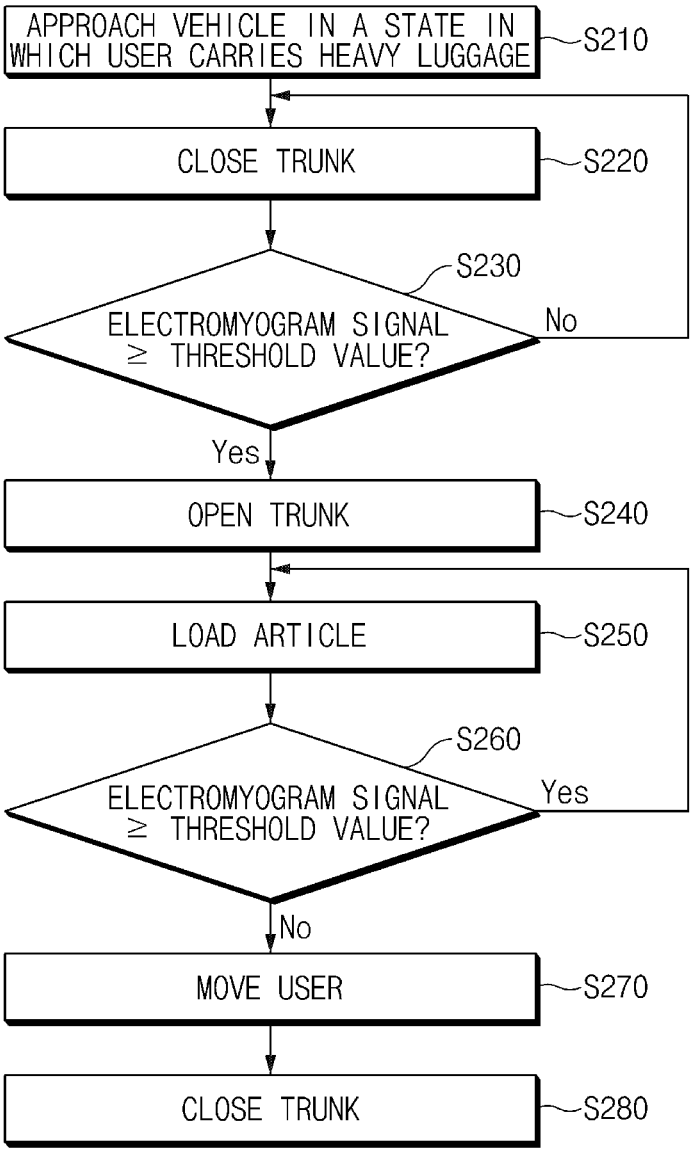
FIG. 2 is an operation flow chart at the time of loading an article into the trunk of a vehicle in the system for controlling a trunk to be opened or closed according to an exemplary embodiment of the present disclosure.

FIG. 2 is an operation flow chart at the time of loading an article into the trunk of a vehicle in the system 100 for controlling a trunk to be opened or closed according to an exemplary embodiment of the present disclosure.

Figure 4:
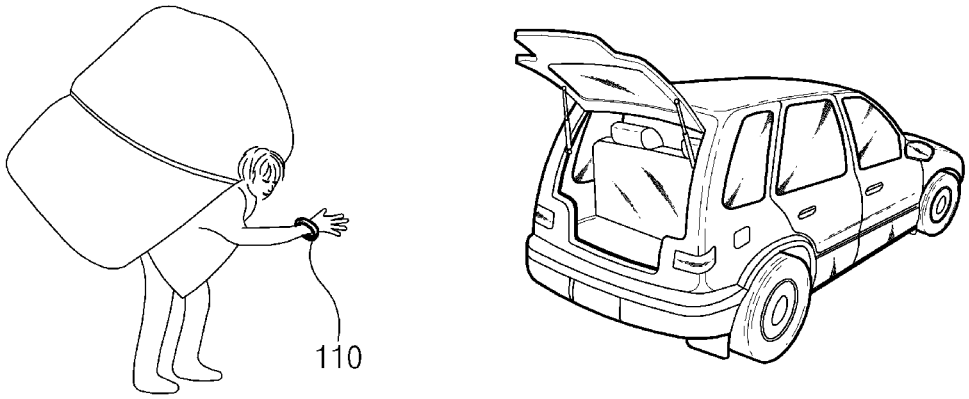
FIG. 4 is a view for decreasing an operation relationship between an electromyogram sensor and the trunk of the vehicle in the system for controlling a trunk to be opened or closed according to an exemplary embodiment of the present disclosure.

First, the user approaches the vehicle in a state in which he/she carries a heavy luggage as shown in FIG. 4 in order to load the luggage into the trunk of the vehicle (S210). Then, it is assumed that the trunk of the vehicle is closed (S220).

The wearable device 110 may transmit the electromyogram signal generated in the electromyogram sensor 111 in the short distance wireless communication scheme (for example, Bluetooth, the Zigbee, NFC, or the like), the mobile communication scheme (for example, WiFi, the WCDMA, Wibro, or the like), the human body communication scheme, or the like, through the communication module 112, and the trunk controller 122 may receive the electromyogram signal through the communicator 121. If necessary, the user may select (for example, button select, or the like) the loading mode in the wearable device 110 at the time of loading the luggage, and the trunk controller 122 may support an operation as described below depending on the loading mode.

The distance sensor 123 senses the distance between the user approaching the vehicle and the vehicle using the ultrasonic sensor, the infrared sensor, the radar sensor, or the like, and the trunk controller 122 measures the strength of the electromyogram signal. The distance sensor 123 may sense the distance from the rear, the side, the front, or the like, of the vehicle to the user depending on a method of installing the ultrasonic sensor, the infrared sensor, the radar sensor, or the like, thereof.

Then, when the strength of the electromyogram signal measured in a state in which the trunk of the vehicle is closed is larger than a predetermined threshold value (S230), the trunk controller 122 drives a predetermined actuator to unlock a locked portion of the trunk of the vehicle, thereby opening the trunk of the vehicle (S240). Here, when the distance from the vehicle (for example, a predetermined rear portion of the vehicle such as a rear bumper, or the like) to the user sensed by the distance sensor 123 is at a predetermined threshold distance or less, the trunk controller 122 may open the trunk of the vehicle.

Then, the user starts to load the article into the trunk of the vehicle and may continuously load other articles while going to and coming back from an ambient place at which other articles are piled in order to further load other articles (S250). Then, when the strength of the electromyogram signal measured at a predetermined period after the trunk of the vehicle is opened is larger than a corresponding threshold value, the trunk controller 122 may maintain the trunk of the vehicle in the opened state (S260).

After all of the articles are loaded in the state in which the trunk of the vehicle is opened as described above, the strength of the electromyogram signal from the wearable device 110 worn by the user does not exceed the threshold value. Here, when the strength of the electromyogram signal measured at a predetermined period attains the corresponding threshold value or less, the trunk controller 122 may directly close the trunk of the vehicle. However, the user may want the trunk of the vehicle to be opened when he/she looks into the trunk or again takes out the article from the trunk while performing other required work in the vicinity of the vehicle. Therefore, it is more preferable to close the trunk of the vehicle when the user becomes distant from the vehicle together with directly closing the trunk of the vehicle depending on the measured strength of the electromyogram signal, rather than directly close the trunk of the vehicle depending on only the measured strength of the electromyogram signal. That is, even though the strength of the electromyogram signal attains the corresponding threshold value or less, when the user moves to another place distant from the vehicle or moves to a driver's seat distant from the rear of the vehicle (S270), such that the distance from the vehicle to the user sensed by the distance sensor 123 (for example, a distance from a predetermined rear of the vehicle, such as a rear bumper, or the like) is at a predetermined threshold distance or more, the trunk controller 122 may close the trunk of the vehicle (S280).

Figure 3:
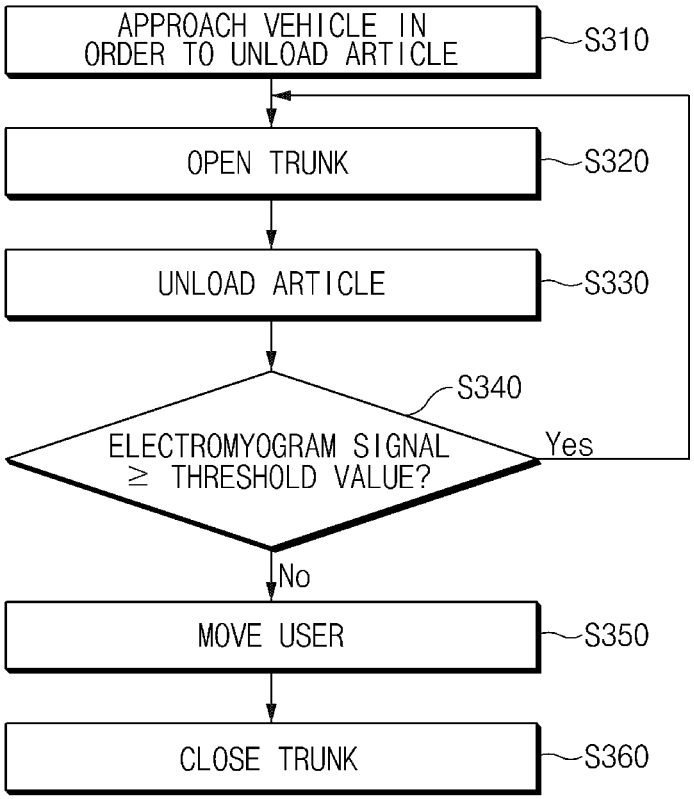
FIG. 3 is an operation flow chart at the time of unloading an article from the trunk of the vehicle in the system for controlling a trunk to be opened or closed according to an exemplary embodiment of the present disclosure.

FIG. 3 is an operation flow chart at the time of unloading an article from the trunk of a vehicle in the system 100 for controlling a trunk to be opened or closed according to an exemplary embodiment of the present disclosure.

First, the user approaches the vehicle in order to unload the article from the trunk of the vehicle (S310). In this case, it is assumed that the trunk of the vehicle has been already opened or the user opens the trunk of the vehicle using a button or an electronic doorlock installed in the vehicle, a key, or the like (S320).

The wearable device 110 may transmit the electromyogram signal generated in the electromyogram sensor 111 in a short distance wireless communication scheme (for example, Bluetooth, Zigbee, NFC, or the like), a mobile communication scheme (for example, WiFi, the WCDMA, Wibro, or the like), or a human body communication scheme through the communication module 112, and the trunk controller 122 may receive the electromyogram signal through the communicator 121. If necessary, the user may select (for example, button select, or the like) the unloading mode in the wearable device 110 at the time of unloading the article, and the trunk controller 122 may support an operation as described below depending on the unloading mode.

The distance sensor 123 senses the distance between the user approaching the vehicle and the vehicle using the ultrasonic sensor, the infrared sensor, the radar sensor, or the like, and the trunk controller 122 measures the strength of the electromyogram signal. The distance sensor 123 may sense the distance from the rear, the side, the front, or the like, of the vehicle to the user depending on method of installing the ultrasonic sensor, the infrared sensor, the radar sensor, or the like.

Then, the user starts to take out and unload the article from the trunk of the vehicle when the trunk of the vehicle is opened, and may continuously unload other articles for a predetermined time while going to and back from an ambient place in order to pile the taken-out article at the ambient place and further take out and unload other articles (S330). Then, when the strength of the electromyogram signal measured at a predetermined period after the trunk of the vehicle is opened is larger than a corresponding threshold value, the trunk controller 122 may continuously maintain the trunk of the vehicle in the opened state (S340).

After all of the articles are unloaded when the trunk of the vehicle is opened as described above, the strength of the electromyogram signal from the wearable device 110 worn by the user does not exceed the threshold value. Here, when the electromyogram signal measured at a predetermined period attains the corresponding threshold value or less, the trunk controller 122 may directly close the trunk of the vehicle. However, the user may want the trunk of the vehicle to be opened when he/she looks into the trunk of the vehicle or further takes out the article from the trunk of the vehicle or again loads the article into the trunk of the vehicle while performing other required work in the vicinity of the trunk of the vehicle. Therefore, it is more preferable to close the trunk of the vehicle when the user becomes distant from the vehicle together with directly closing the trunk of the vehicle depending on the measured strength of the electromyogram signal rather than to directly close the trunk of the vehicle depending on only the measured strength of the electromyogram signal. That is, even though the strength of the electromyogram signal attains the corresponding threshold value or less, when the user moves to another place distant from the vehicle or moves to a driver's seat distant from the rear of the vehicle (S350), such that the distance from the vehicle to the user sensed by the distance sensor 123 (for example, a distance from a predetermined rear of the vehicle, such as a rear bumper, or the like) is at a predetermined threshold distance or more, the trunk controller 122 may close the trunk of the vehicle (S360).

Meanwhile, as described above, the interface 124 may transmit the above-mentioned electromyogram signal to another electronic device in the wired scheme or the wireless scheme (the short distance wireless communication scheme, the mobile communication scheme, or the like) to interwork with the health care or the navigation service.

For example, the electronic device for the application as described above may be a smart phone. In this case, when a health care application service is possible in the smart phone, the electromyogram signal may become an input signal for health care treatment. The smart phone may provide an interworking service collecting health care related information such as heart rate, pulse rate, and the like, from the electromyogram signal, transmitting the collected information to a medical institution (server), or the like, receiving predetermined health care service information from the medical institution, and outputting or displaying the received information.

In addition, for example, the electronic device for the application as described above may be a navigation terminal. In this case, when a navigation service depending on direction indication is possible in the navigation terminal, the electromyogram signal may become an input signal for direction indication. To this end, a plurality of wearable devices 110, for example, two or more wearable devices 110 may be used. When two wearable devices 110 are used and are worn on left and right arms, respectively, and a left or right direction indication input is generated depending on the electromyogram signal on the left or right arm, a required service may be provided depending on a left or right turn state of a driver in a turn by turn (TBT) service of the navigation terminal, or the like. For example, the navigation terminal may compare a state of the driver with the left or right turn state of the driver when a turn is required and provide right driving directivity when the left turn is required, when the right turn is required, or the like, by strong vibrations, or the like, when the state of the driver is different from the left or right turn state of the driver.

As described above, the system 100 for controlling a trunk to be opened or closed according to an exemplary embodiment of the present disclosure may automatically open the trunk when the electromyogram (EMG) signal of the user approaching the trunk of the vehicle in order to load the article is at a predetermined value or more and close the trunk by judging the strength of the electromyogram signal, the distance of the user from the trunk, and the like, when the loading of the article is completed. In addition, at the time of unloading the article, the system 100 according to an exemplary embodiment of the present disclosure may maintain the trunk in the opened state when the electromyogram signal is at a predetermined value or more when the user unloads the article from the trunk of the vehicle and close the trunk by judging the strength of the electromyogram signal, the distance of the user from the trunk, and the like, when unloading of the article is completed. Therefore, the system 100 for controlling a trunk to be opened or closed according to an exemplary embodiment of the present disclosure is used, thereby making it possible to conveniently open or close the trunk of the vehicle in a non-contact manner, human body communication, or the like, regardless of a specific gesture of the user.

Hereinabove, although the present disclosure has been described by specific matters such as detailed components, and the like, exemplary embodiments, and the accompanying drawings, they have been provided only for assisting in the entire understanding of the present disclosure. Therefore, the present disclosure is not limited to the above-mentioned exemplary embodiments, but may be variously modified and altered by those skilled in the art to which the present disclosure pertains without departing from the spirit and scope of the present disclosure. Therefore, the present disclosure is not to be limited to the above-mentioned exemplary embodiments. That is, the following claims as well as all contents modified equally or equivalently to the claims are to fall within the scopes and spirits of the disclosure.

What is claimed is:

1. A method for controlling a trunk of a vehicle to be opened or closed, comprising:

generating an electromyogram signal for reactivity of the body of a user using an electromyogram sensor worn on the body and transmitting the electromyogram signal, wherein a strength of the electromyogram signal from the electromyogram sensor worn on an arm of the user is measured to open or close the trunk of the vehicle; and controlling the trunk of the vehicle to be opened or closed depending on the strength of the electromyogram signal received by the vehicle and distance of the user from the vehicle.

2. The method for controlling a trunk of a vehicle to be opened or closed according to claim 1, wherein, in a state in which a wearable device including the electromyogram sensor and a communication module wirelessly transmitting the electromyogram signal is worn on the body of the user, the vehicle wirelessly receives the electromyogram signal from the communication module of the wearable device.

3. The method for controlling a trunk of a vehicle to be opened or closed according to claim 1, wherein, in a state in which a wearable device including the electromyogram sensor and a communication module transmitting the electromyogram signal through human body communication is worn on the body of the user, the vehicle receives the electromyogram signal from the communication module of the wearable device through the human body communication.

4. The method for controlling a trunk of a vehicle to be opened or closed according to claim 1, wherein the vehicle transmits the electromyogram signal to an electronic device in a wired or wireless scheme to control the electromyogram signal to be used as an input signal for health care treatment or an input signal for direction indication in the electronic device.

5. The method for controlling a trunk of a vehicle to be opened or closed according to claim 1, wherein the controlling of the trunk of the vehicle to be opened or closed includes opening the trunk of the vehicle when the strength of the electromyogram signal is larger than a threshold value in a state in which the trunk of the vehicle is closed and maintaining the trunk of the vehicle in an opened state when strength of the electromyogram signal measured at a predetermined period is larger than the threshold value.

6. The method for controlling a trunk of a vehicle to be opened or closed according to claim 5, wherein the trunk of the vehicle is closed when the user moves from a rear of the vehicle by a predetermined distance or more, in the case in which the strength of the electromyogram signal measured at the predetermined period is the at threshold value or less after the trunk of the vehicle is opened.

7. The method for controlling a trunk of a vehicle to be opened or closed according to claim 1, wherein the controlling of the trunk of the vehicle to be opened or closed includes maintaining the trunk of the vehicle in an opened state when strength of the electromyogram signal measured at a predetermined period is larger than a threshold value in a state in which the trunk of the vehicle is opened.

8. The method for controlling a trunk of a vehicle to be opened or closed according to claim 7, wherein the trunk of the vehicle is closed when the user moves from a rear of the vehicle by a predetermined distance or more, in the case in which the strength of the electromyogram signal measured at the predetermined period is the threshold value or less.

9. A system for controlling a trunk of a vehicle to be opened or closed, comprising:

a communicator configured to receive an electromyogram signal for reactivity of the body of a user generated in an electromyogram sensor worn on the body of the user;

a distance sensor configured to sense a distance of the user from the vehicle; and a trunk controller configured to control the trunk of the vehicle to be opened or closed depending on strength of the electromyogram signal and the distance of the user from the vehicle, wherein the trunk controller measures the strength of the electromyogram signal from the electromyogram sensor worn on an arm of the user to open or close the trunk of the vehicle.

10. The system for controlling a trunk of a vehicle to be opened or closed according to claim 9, wherein the communicator is configured such that in a state in which a wearable device including the electromyogram sensor and a communication module wirelessly transmitting the electromyogram signal is worn on the body of the user, the communicator wirelessly receives the electromyogram signal from the communication module of the wearable device.

11. The system for controlling a trunk of a vehicle to be opened or closed according to claim 9, wherein the communicator is configured such that, in a state in which a wearable device including the electromyogram sensor and a communication module transmitting the electromyogram signal through human body communication is worn on the body of the user, the communicator receives the electromyogram signal from the communication module of the wearable device through the human body communication.

12. The system for controlling a trunk of a vehicle to be opened or closed according to claim 9, further comprising an interface configured to transmit the electromyogram signal to an electronic device in a wired or wireless scheme, wherein the interface controls the electromyogram signal to be used as an input signal for health care treatment or an input signal for direction indication in the electronic device.

13. The system for controlling a trunk of a vehicle to be opened or closed according to claim 9, wherein the trunk controller is configured to open the trunk of the vehicle when the strength of the electromyogram signal is larger than a threshold value when the trunk of the vehicle is closed and maintain the trunk of the vehicle in an opened state when strength of the electromyogram signal measured at a predetermined period is larger than the threshold value.

14. The system for controlling a trunk of a vehicle to be opened or closed according to claim 13, wherein the trunk controller is configured to close the trunk of the vehicle when the user moves from a rear of the vehicle by a predetermined distance or more, when the strength of the electromyogram signal measured at the predetermined period is the threshold value or less after the trunk of the vehicle is opened.

15. The system for controlling a trunk of a vehicle to be opened or closed according to claim 9, wherein the trunk controller is configured to maintain the trunk of the vehicle in an opened state when strength of the electromyogram signal measured at a predetermined period is larger than a threshold value in a state in which the trunk of the vehicle is opened.

16. The system for controlling a trunk of a vehicle to be opened or closed according to claim 15, wherein the trunk controller is configured to close the trunk of the vehicle when the user moves from a rear of the vehicle by a predetermined distance or more, when the strength of the electromyogram signal measured at the predetermined period is at the threshold value or less.

* * * * *